US005338007A

United States Patent [19]

Hinton

[11] Patent Number: 5,338,007

[45] Date of Patent: Aug. 16, 1994

[54] IMPROVEMENTS IN FENCING

[76] Inventor: Thomas R. Hinton, 113 Newcastle Rd., Hamilton, New Zealand

[21] Appl. No.: 90,471

[22] Filed: Jul. 12, 1993

Related U.S. Application Data

[63] Continuation of Ser. No. 768,050, Sep. 30, 1991, abandoned.

[30] Foreign Application Priority Data

Oct. 3, 1990 [NZ] New Zealand ..... 235544

[51] Int. Cl.[5] ..... E04H 17/00

[52] U.S. Cl. ..... 256/48; 256/56; 256/10

[58] Field of Search ..... 256/48, 47, 10, 53, 256/50, 56, 54, 71, 70, 52, 58, DIG. 5; 403/405.1–409.1, 387, 395, 397, 347, 374; 52/282, 738; 404/6, 9, 10; 174/158 F, 161 F, 163 F; 24/115 M, 136 R, 460, 462

[56] References Cited

U.S. PATENT DOCUMENTS

| | | | |
|---|---|---|---|
| 199,490 | 1/1878 | Bain | 256/56 |
| 359,463 | 3/1887 | Orr | 256/56 |
| 458,821 | 9/1891 | Brookbank | 256/56 |
| 536,060 | 3/1895 | Baer | 256/56 |
| 632,585 | 9/1899 | Parker | 256/56 |
| 687,142 | 11/1901 | Ewbank | 256/56 |
| 801,713 | 10/1905 | Dutton | 256/56 |
| 837,574 | 12/1906 | Johnston | 256/56 |
| 1,028,630 | 6/1912 | Stryker | 256/53 |
| 1,636,126 | 7/1927 | Christensen | 256/58 |
| 1,661,528 | 3/1928 | Dunlap | 256/58 |
| 2,220,203 | 11/1940 | Branin | 24/136 R |
| 2,222,249 | 11/1940 | Borgen | 256/48 |
| 2,515,615 | 7/1950 | Tetzlaff | 256/48 |
| 2,821,365 | 1/1958 | Lach | 256/10 X |
| 3,464,671 | 9/1969 | Thomas | 256/10 |
| 4,054,269 | 10/1977 | Stabler | 256/48 |

FOREIGN PATENT DOCUMENTS

| | | | |
|---|---|---|---|
| 4184 | of 1882 | United Kingdom | 256/53 |

*Primary Examiner*—Randolph A. Reese
*Assistant Examiner*—Harry C. Kim
*Attorney, Agent, or Firm*—Knobbe, Martens, Olson & Bear

[57] ABSTRACT

The disclosure relates to fence battens and clips and improved methods of attaching a fence wire. A variety of battens are described characterised by having slots into which a wire may be inserted. A variety of interacting clips which can be used to subsequently fasten the wire with respect to the batten are also described. The battens and clips are especially suitable for electric fences.

13 Claims, 4 Drawing Sheets

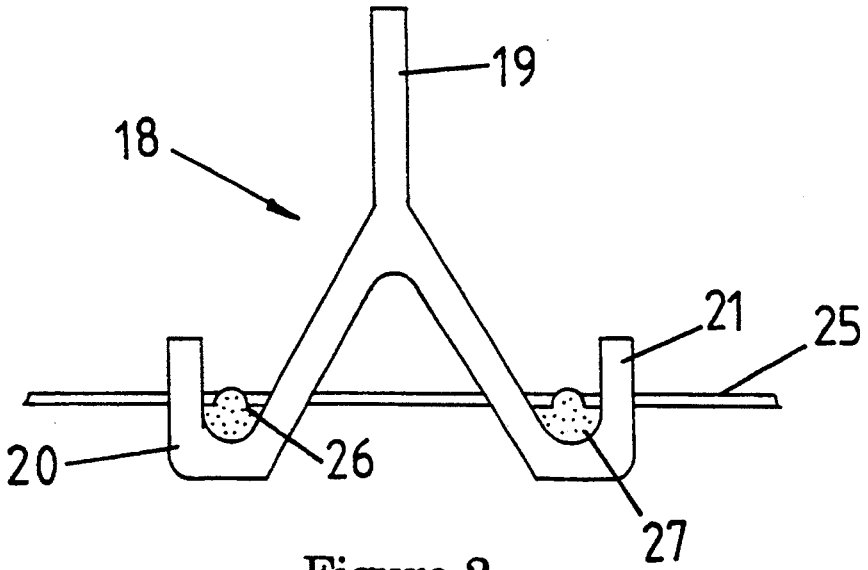
Figure 2
Figure 1
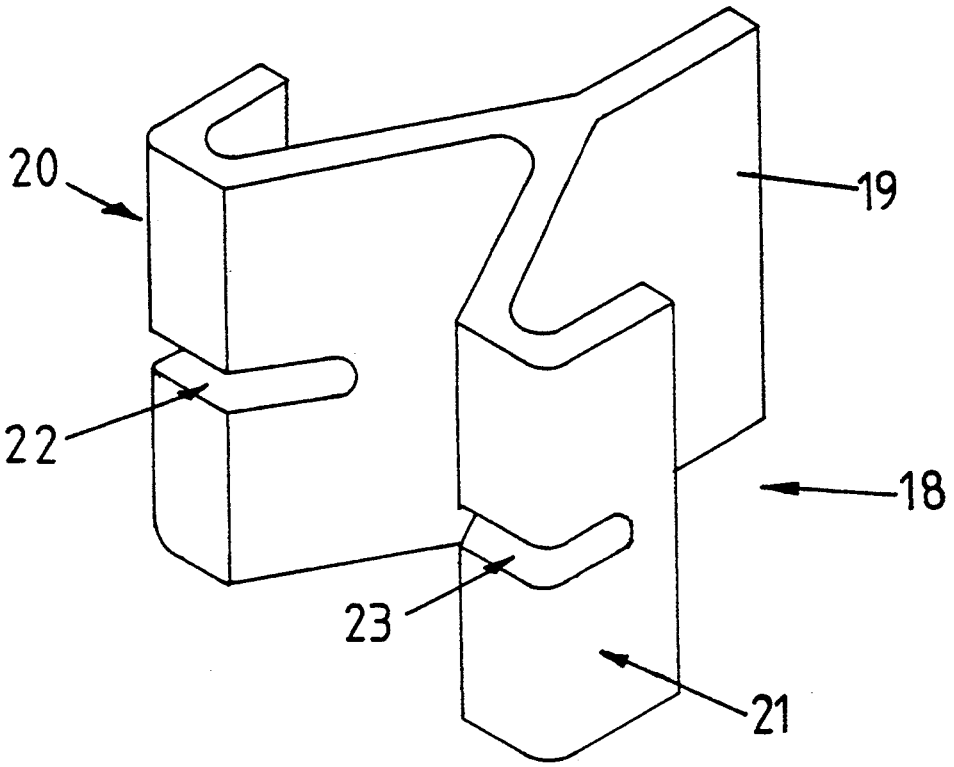

IMPROVEMENTS IN FENCING

This application is a continuation of application Ser. No. 07/768,050, filed Sep. 30, 1991, now abandoned.

BACKGROUND OF THE INVENTION

This invention relates to fencing battens and clips.

More specifically, this invention relates to fencing battens with wire retaining characteristics which allow for only a minimal or reduced amount of wire slippage with respect to the battens.

It is normally desirable to be able to erect a (batten and wire) fence with the fence wires firmly fixed to the battens so that slippage of the battens with respect to the wires will not occur. It is also desirable to be able to erect such fences quickly and efficiently.

Wooden battens are frequently used for this type of fencing, the fence wires being attached to the battens by staples and/or ties. Erecting fences in this manner is not only slow and laborious, but the staples/ties often work themselves loose over a period of time, thus allowing for slippage of the battens with respect to the wires. Moreover, batten and wire fences are often required to be disassembled (for example, a farmer may wish to change the shape/size of his paddocks depending upon the season), and it is clear therefore that a fence constructed in this manner will not readily permit this.

There are known a number of channel-shaped fencing battens which retain the wires in slots or holes therein, the wires being held in place by wedges or pins. While these battens allow for a fence to be more easily erected and/or disassembler, slippage of the wire with respect to the battens often occurs as only a small portion of the batten is utilised in retaining each wire. As well, the wedges or pins used to hold the wires in place often work loose or are simply not capable of holding the wires firmly onto the batten. Furthermore, fence wires are often damaged in attempts to significantly eliminate wire slippage with respect to the batten.

It is an object of the present invention to address the foregoing problems or at least to provide the public with a useful choice.

Further objects and advantages of the present invention will become apparent from the following description which is given by way of example only.

SUMMARY OF THE INVENTION

Briefly stated, the invention comprises improved fence battens in combination with one or more clips that attach to the battens for supporting one or more fence wires. The batten includes a body having a main stem with at least one stiffening rib extending outwardly from a face of the stem. The rib has a head or flange spaced from the stem face and has one or more fence wire accommodating slots leading to a wire backing area on the stem face. Preferably, the backing area extends substantially across the stem face and is aligned with the fence wire to be positioned in the slot. A clip is provided for mounting on the batten to retain the wire in position. The clip has a body with an internal opening or removed portion which is complementary to the stiffening rib head so as to form a keyed relationship when the clip is attached to the rib. The clip has a rear surface which faces the wire backing area on the stem face to clamp the wire between the clip and the stem face. Preferably, this rear face is tapered or has a series of steps to facilitate gripping of wire, of varying diameter.

In one form of the invention, the clip has one or more protrusions including into its interior opening which bear against and exert pressure on the batten rib to which the clip is attached. It is desirable that the batten be made of non-conducting or electrically insulating material, particularly material which is temporarily deformable and resilient.

In accordance with a method of using the batten, the fence wire is inserted into the slot in the batten, and the clip is positioned on the head of the batten rib to sandwich the wire between the clip's rear face and the wire backing area of the batten. In this manner, the clip is positioned so that its rear face exerts pressure on the wire to hold it in position. Advantageously, a series of wires may be attached to a single batten with each wire being held by an individual clip.

BRIEF DESCRIPTION OF THE DRAWINGS

FIG. 1 is a perspective view of one form of fence batten;

FIG. 2 is a top plan view of the batten of FIG. 1 with a wire and a wedge fitted into the batten;

DETAILED DESCRIPTION

EXAMPLE 1

Figure 3:
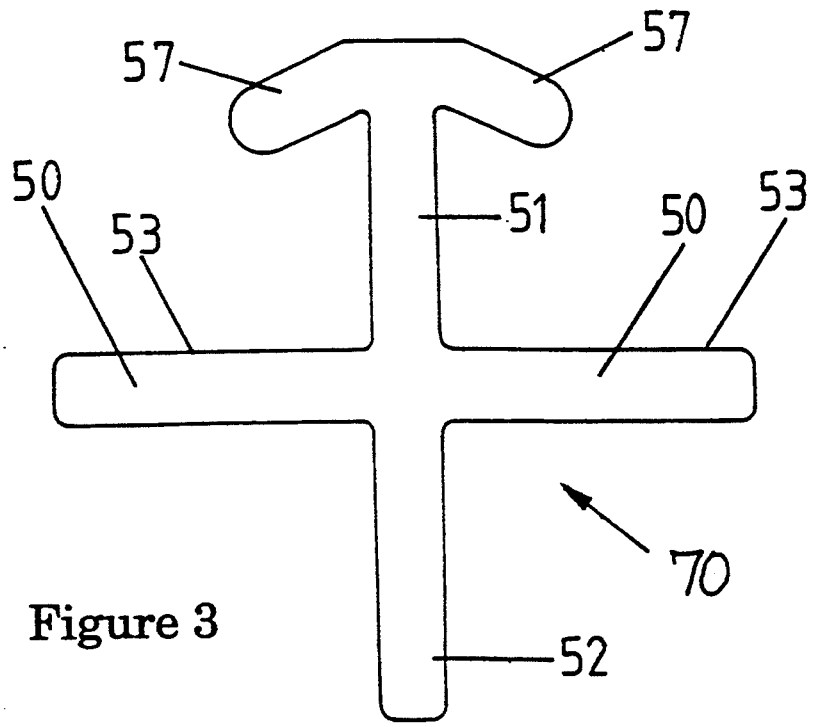
FIG. 3 is a top plan view of a further embodiment of a batten of the invention.

According to one embodiment of the present invention there is provided a fence batten generally which is substantially V-shaped in cross-section.

There are provided in the fence batten a number of transverse slots from the apex of the V for the reception and retention of fence wires . The slots generally will accept up to 4 mm (8 gauge) fencing wire. The slots are angled downwardly (with respect to an upright batten) thus providing means whereby a wire may be temporarily retained within the slot before being engaged by a wedge passing between the internal face of the V and the wire entered into the slot. Needless to say the slot should be sufficiently deep so that when a wire is inserted therein, there is a space between the wire and the internal apex of the 'V'.

The wedge is tapered, as a wedge generally is, and may include barbs or other protrusions to interact with a wire so as to hinder its removal after insertion. Depressions in the body of the wedge to accommodate the contour of a wire may also be provided. A head may be provided to aid insertion.

There are also provided in the batten two parallel ribs extending vertically down the outside face of the batten. These fibs are aligned with the innermost edge of the (wire) slots and provide additional faces for a wire to rest against once it have been inserted into a slot and held in position by a wedge. Essentially the ribs, apart from providing additional strength to the batten, increase the cross-section of batten that the wires actually contact and help prevent a wire cutting further into the batten.

Pressure is exerted upon the fence wire in three separate contact points—the wedge and each side of the 'V'-batten which are typically perpendicular to each other.

The wedge and batten may be made from UV resistant polyethylene though other plastics materials (or electrically insulating materials for electric fence wire) may be used. The clips need not be electrically insulating.

EXAMPLE 2

With respect to FIGS. 1 and 2 there is a further embodiment of a fence batten generally indicated by arrow 18. The fence batten 18 which is a modification of that of example 1, is substantially Y-shaped in cross-section. The batten 18 consists of a central portion 19 having two outwardly extending and substantially V-shaped portions 20, 21.

In each V-shaped portion 20, 21 there are provided transverse slots 22, 23, said slots being adapted to receive and retain a fence wire 25 therein. As shown by FIG. 2, the fence wire 25 is held in place by wedges 26, 27 which are positioned between the wire 25 and the back portions of the V-shaped portions 20, 21. The wedges 26, 27 fill up the entire space between the back portions of the V-shaped portions 20, 21 and the fence wire 25.

Pressure is placed upon the wire 25 across the entire width of the batten 18 and therefore any slippage which may occur between the batten 18 and the wire is minimised.

EXAMPLE 3

In another embodiment of the present invention there is provided a substantially U-shaped fence batten. In this embodiment the fence wire is received and retained within transverse slots which are provided in the batten and extend through the face representing the base of the 'U' or channel and partially into the sides of the 'U'. The wire is held in place by a wedge positioned between the wire and internal face of said base of the 'U'. This embodiment is similar to example 1 and pressure is exerted on the fence wire at three separate contact points which take advantage of the full width of the batten.

A wedge similar to in the other examples (1–2) may be used. Alternatively, a modified wedge where the rear pan of the head extends beyond the body may be used to exert additional pressure on the rear portion of the batten.

EXAMPLE 4

FIG. 3 illustrates a further preferred embodiment of a fence batten 50. This batten comprises a body having a stem (50) with at least one stiffening rib 51, 52 or protrusion thereon;

said stem 50 having, on at least one face 53, at least one wire backing area, generally indicated by arrow 54, which comprises a substantial proportion of the width of said stem 50;

each said backing area 54 being accessible to a wire 55, substantially transverse to the body, to be supported, and further wherein said wire 55 when supported will contact substantially the entire width of a said backing area 54;

said body being adapted to receive a clip 56 which will sandwich a supported wire 55 against a backing area 54 which it contacts.

The front fib 51 has flanges 57 along its forward edge. These flanges 57 extend either side of rib 51 so that the rib and flanges 51, 57 appear substantially 'T' shaped in cross section. In the illustrated embodiment, the flanges 57 are angled slightly towards the front face 53 of the batten.

The rear fib 52 is substantially rectangular in cross section though may comprise a number of possible cross sectional configurations. Similarly several additional ribs could also be provided on the illustrated embodiment. The embodiment of a batten in FIG. 3 is substantially '+' shaped in cross section and is preferentially constructed of a plastics material such as high impact PVC or high density polyethylene, though other materials may also be used.

The span of the front face 53 in the preferred illustrated embodiment is 20 mm, though the batten may be scaled up or down as required. The forward face 53 may also possess forwardly extending flanges (preferably near the outer ends) with slots therein aligned to help locate a transverse wire 55.

Figure 4:
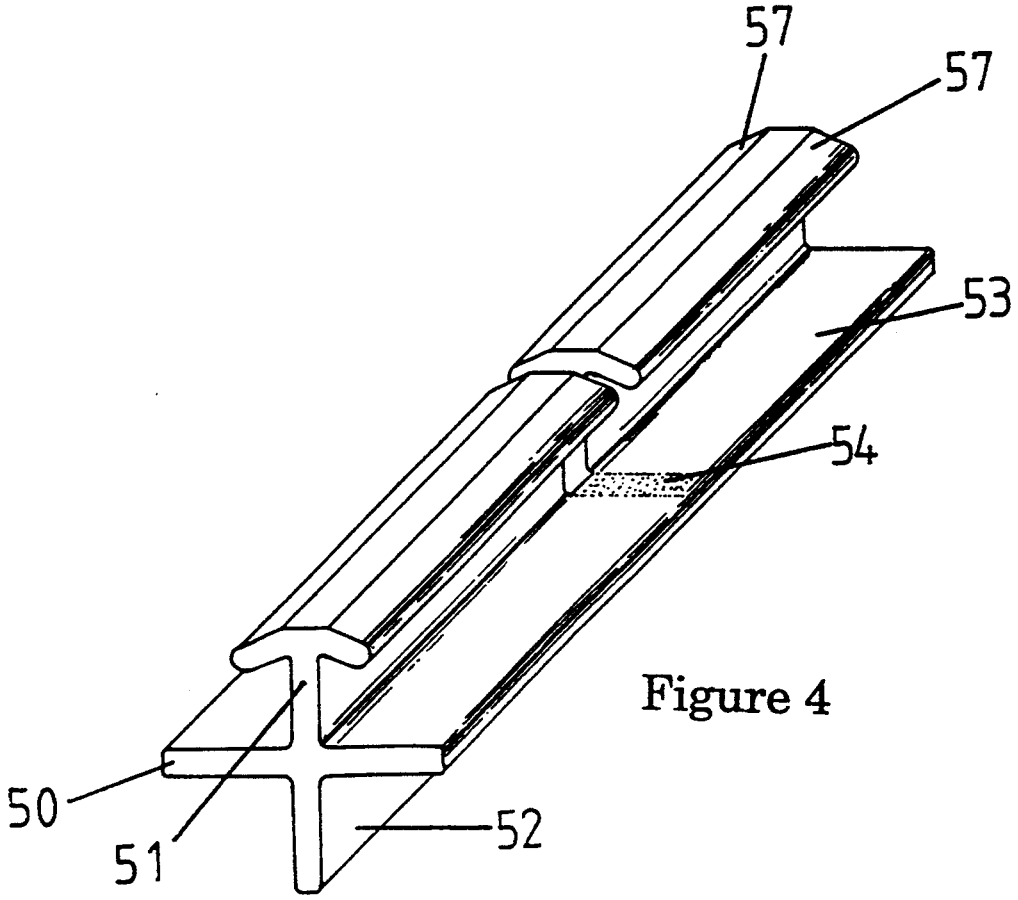
FIG. 4 is a diagrammatic front perspective view of the batten of FIG. 3.
Figure 5:
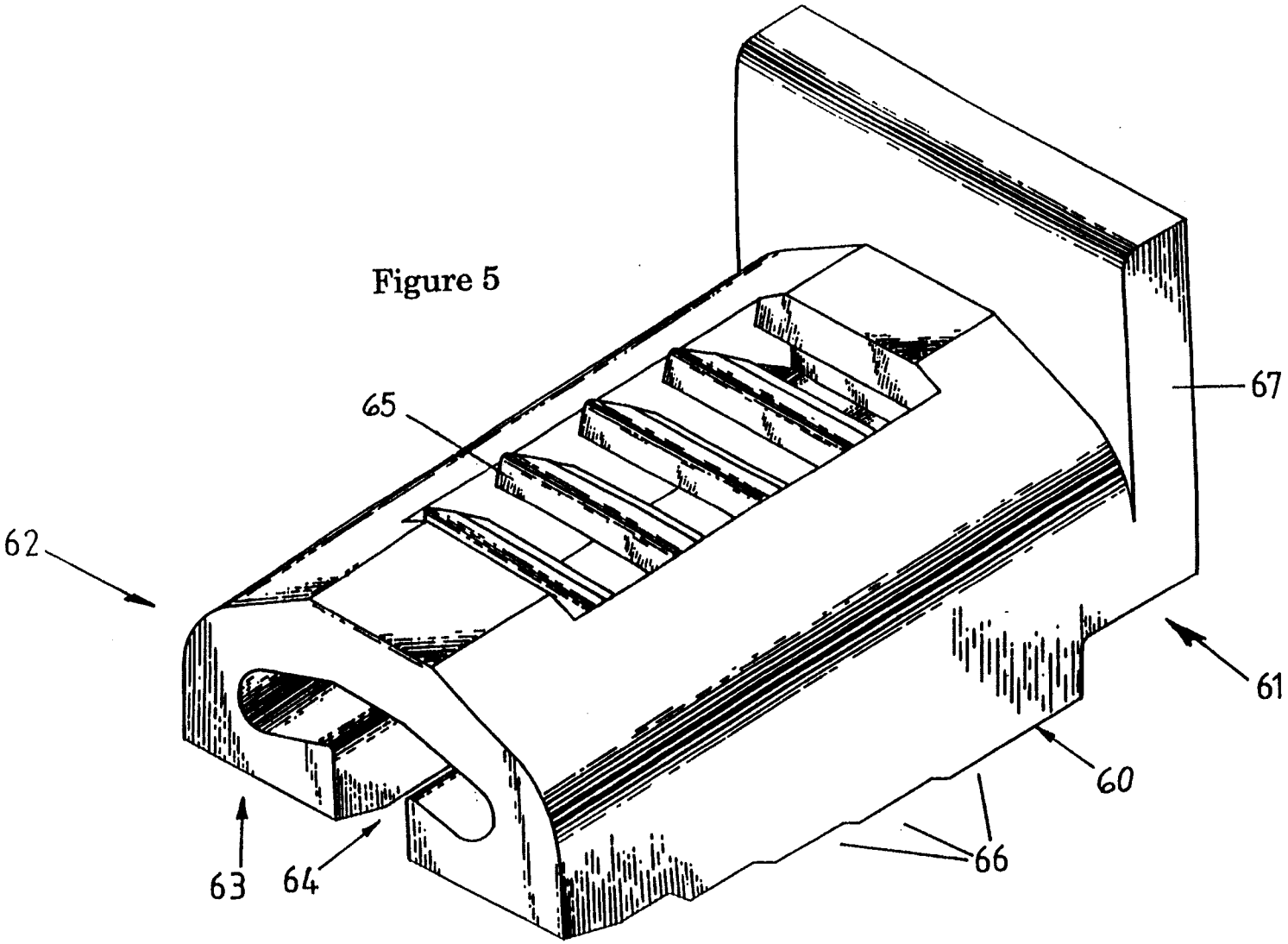
FIG. 5 is a perspective side view of a clip for use with the batten of FIGS. 3 and 4.
Figure 6:
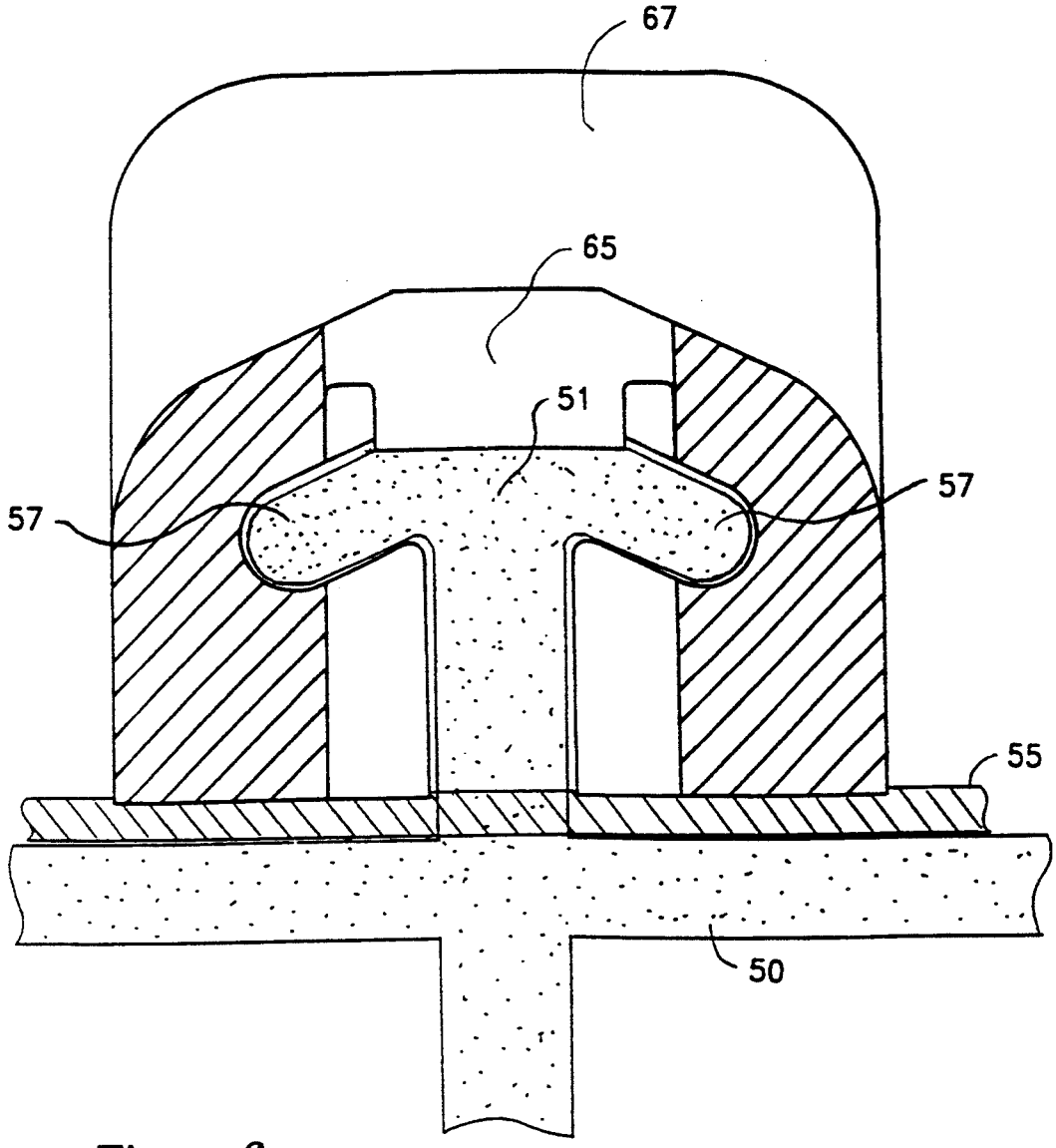
FIG. 6 is a diagrammatic transverse cross-sectional view of the clip of FIG. 5, in use with the batten of FIGS. 3 and 4 and a wire.

A clip for use with the fence batten illustrated in FIGS. 3 and 4 is illustrated in FIGS. 5 and 6. This clip comprises:

a body 60 having a top end 61 and a bottom end 62;

said body having a rear face 63 which faces the backing region 54 of a batten 70 when the clip 60 is attached thereto;

said body 60 having a removed portion 64 substantially complementary to a rib 51 and flange 57 or protrusion on said batten 70, said removed portion 64 accommodating said rib 51 and flange 57 or protrusion when the clip 60 is attached to the batten 70.

In the illustrated embodiment, the rear face 63 of the clip comprises a series of steps and graduations 66 so that when the clip 60 is fitted to said batten 70, said rear face 63 of the clip 60 is generally closer to said backing region 54, near its top 61 than at its bottom 62 end.

From the illustrations it can be seen that the cross section of the removed portion 64 of the clip 60 is substantially the same as the rib 51 and flange 57 of the batten 70. This keyed interrelationship is best seen in FIG. 6. To main the clip 60 in a tight relationship with the rib 51 and flange 57, a series of downward protrusions 65 are provided from the body 60 of the clip and which extend into the top of the removed portion 64. These downward protrusions 65 will bear against the top of the flange 57 of the batten 70. In the illustrated embodiment, these downward protrusions 65 are provided by a series of louvres, each louvre being deformable (by being able to bend slightly upwardly) to allow the clip 60 to be fitted to the batten.

As can be seen in the figures, the steps and graduations 66 on the rear face 63, allow a range of differently sized wires 55 to be accommodated by the clip 60.

The clip also comprises a head 67 which extends forwardly of the main body 60—the head aiding attachment of the clip to the batten 70.

The clip 60 is attached to a batten 70 by a partial sliding and press-fitting action. While several means of attaching the clip may be used, such as sliding the clip along the rib 5 1 and flange 57, normally one end, typically the bottom 62, is positioned and pressed into place, the clip being positioned such that the body 60 is over the wire 55. Then with a slight downward sliding action, the clip may be pressed finally into place.

The nature of the clip illustrated is such that it may be more readily attached to the batten 70 than removed—this is partially due to the downward angle of the flanges 57. If necessary, a clip may be removed or slid out of the way though removal may result in damage to the clip depending on the manner by which it is removed, and the materials of construction.

Typically the clip is constructed of a plastics material, with material such as nylons, high density polyethylenes and UV resistant PVC being preferred options.

Aspects of the present invention have been described by way of example only and it should be appreciated that additions and modifications may be made thereto without departing from the scope as defined in the appended claims.

I claim:

1. A fence construction for supporting at least one fence wire, comprising:

a batten including a body having a stem with at least one stiffening rib extending from a face of said stem, said rib having a head spaced from said stem face, said rib having at least one fence wire accommodating slot leading to a wire backing area on said stem face, said wire backing area extending substantially across said stem face and being aligned with said wire when positioned within said slot; and a clip including a body having a removed portion, complementary to said stiffening rib head, forming a keyed relationship when said clip is attached to said rib, said clip body including segments between said head and said backing area and each having a rear surface facing said wire backing area and positioned so that when said clip is mounted on said batten over said wire in said slot, said wire is clamped between said clip segments and said area and prevented from transverse movement relative to said batten and said clip, said clip having one or more protrusions intruding into said removed portion which bear against, and exert a pressure on, said rib to which said clip is attached.

2. The construction of claim 1, wherein said rear surface of said clip is tapered or has a series of steps of accommodate different sizes of wire.

3. The construction of claim 2, wherein said batten is of a non-conducting or electrically insulating material.

4. The construction of claim 2, wherein said batten has a plurality of slots along its length to accommodate said fence wire.

5. The construction of claim 4, wherein one of said clips is provided for each of said slots in which a wire is positioned.

6. A method of supporting a plurality of substantially parallel fence wires by the batten and clip combination of claim 4, wherein each individual fence wire is positioned within a respective one of the slots and a respective one of said clips is positioned on said rib head over each of said fence wires to sandwich said wires against said batten, and to exert pressure on said rib head to hold said clip in a selected position on said rib.

7. The method of claim 6, wherein each of said clips exerts pressure on the respective one of said wires it sandwiches against said batten.

8. The construction of claim 2, wherein said clip is formed of a temporarily deformable resilient material.

9. The construction of claim 1, wherein said removed portion extends substantially the length of said clip body.

10. The construction of claim 1, wherein said rear surfaces extend substantially the length of said clip body.

11. The construction of claim 1, wherein said rib and said rib head form a generally T-shaped cross-section and wherein said protrusions engage a central portion of one side of said head causing portions of said clip body to engage an opposite side of said head on each side of said rib.

12. A method of supporting a fence wire by the batten and clip combination of claim 1, comprising:

inserting said fence wire into said fence wire accommodating slot; and positioning said clip on said rib head to sandwich said fence wire between said clip's rear surface and said wire backing area of said batten so that said wire is not moveable relative to said batten and clip combination, said positioning step including exerting pressure on said rib head with said protrusions to maintain said clip in a selected position.

13. The method of claim 12, wherein said clip is positioned so its rear surface exerts pressure on said fence wire.

* * * * *